United States Patent [19]

Kavčič

[11] Patent Number: 4,691,194

[45] Date of Patent: Sep. 1, 1987

[54] ELECTRIC ALARM SIREN WITH ARC-LIKE RUNNER LEGS

[75] Inventor: Janez Kavčič, Železniki, Yugoslavia

[73] Assignee: Iskra-Sozd elektrokovinske industrije n.sol.o, Ljubljana, Yugoslavia

[21] Appl. No.: 640,574

[22] Filed: Aug. 14, 1984

[30] Foreign Application Priority Data

Oct. 11, 1983 [YU] Yugoslavia ..... 2052/83

[51] Int. Cl.[4] ..... E01F 9/00

[52] U.S. Cl. ..... 340/405; 116/147

[58] Field of Search ..... 416/228, 223 R; 340/405, 384 R, 384 E; 116/147

[56] References Cited

U.S. PATENT DOCUMENTS

| | | | |
|---|---|---|---|
| 2,017,132 | 10/1935 | Ricci | 340/405 |
| 2,314,260 | 3/1943 | Williamson | 340/405 |
| 2,756,416 | 7/1956 | Griparis | 340/405 |
| 2,855,141 | 10/1958 | Van Rijn . | |
| 2,926,838 | 3/1960 | Van Rijn . | |
| 3,029,870 | 4/1962 | Heller . | |
| 3,121,220 | 2/1964 | Buckwalter | 340/405 |
| 3,237,849 | 3/1966 | Krell . | |
| 3,310,698 | 3/1967 | Krell . | |
| 3,378,192 | 4/1968 | Friese . | |
| 3,453,616 | 7/1969 | Murray | 340/405 |
| 4,063,852 | 12/1977 | O'Connor . | |
| 4,138,673 | 2/1979 | Faust | 340/405 |
| 4,393,374 | 7/1983 | Bandelj | 340/405 |
| 4,558,656 | 12/1985 | Powell | 340/405 |

FOREIGN PATENT DOCUMENTS

| | | | |
|---|---|---|---|
| 46985 | 3/1974 | Australia | 340/405 |
| 2551614 | 5/1976 | Fed. Rep. of Germany . | |
| 130976 | 5/1978 | Fed. Rep. of Germany . | |
| 560283 | 11/1922 | France | 340/405 |
| 2371034 | 7/1978 | France | 340/405 |

OTHER PUBLICATIONS

Abstract of French Patent Document 2,275,839.

*Primary Examiner*—John W. Caldwell, Sr.
*Assistant Examiner*—Tyrone Queen
*Attorney, Agent, or Firm*—Fleit, Jacobson, Cohn & Price

[57] ABSTRACT

An electric alarm siren of low power has a relatively high sound intensity and a good timbre due to a runner with arch-shaped blades.

The electric alarm siren includes a central part which is divided by a partition wall into a driving part with a built-in motor being enclosed in a compact whole by a cover, and into an acoustical part comprising the runner and a front part.

1 Claim, 7 Drawing Figures

ELECTRIC ALARM SIREN WITH ARC-LIKE RUNNER LEGS

The technical problem that the invention should solve is the construction of a siren having a good timbre and relatively high sound intensity and the siren and electromotor being relatively small sized, compact and reliable.

An electrical alarm siren of low power is disclosed in the Yogoslav Pat. Appln. No. P 816/80, which corresponds to U.S. Pat. No. 4,393,374. The siren consists of a supporting part onto which a driving electromotor is fixed with a cover over the motor. The front sound generating part is made in the form of a funnel-shaped horn with air outlet orifices along the circumference. A runner is fastened to the motor shaft and is placed in the front part at the height of the orifices and has radial blades provided with air cutters at their ends. The siren has a good sound timbre, but does not reach a maximum efficiency, i.e. maximum loudness.

Another siren of this type is disclosed in the Patent FR 2 371 034. The siren has no housing, the runner is provided with a ring along the outer edge of the air cutters and rotates in the front part with orifices along the circumference. The runner has radial blades, the front part is not formed as a funnel-shaped horn. The sound efficiency is still lower than the siren according to the Yogoslav Pat. Appln. P 816/80, which corresponds to U.S. Pat. No. 4,393,374.

OBJECTS AND SUMMARY OF THE INVENTION

It is the aim of the invention to provide an electric siren of low power with relatively high intensity and good timbre of sound. The low power electric alarm siren in accordance with the invention is made of aluminium casting in such a way that the runner has arch-shaped blades, which substantially affects the intensity and colour of the sound. The runner rotates in the supporting central part.

BRIEF DESCRIPTION OF THE DRAWINGS

The invention will be described in more detail with the aid of the drawings, which show.

DETAILED DESCRIPTION

Figure 7:
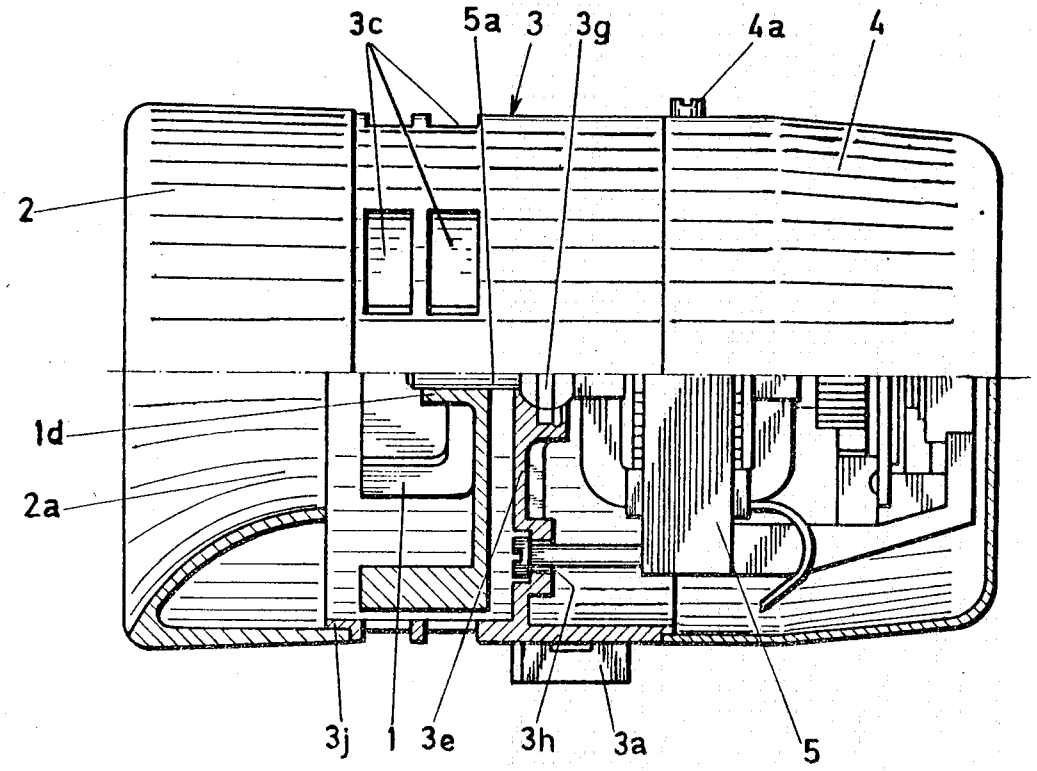
FIG. 7 illustrates a side view of the siren in accordance with the invention with a partial sectional view.

The electric alarm siren in accordance with the invention includes the following parts: a runner 1 with arch-shaped blades 1*c*, a front part 2 having a funnel-shaped nozzle, a central part 3 with fixing accessories for an electromotor 5, a front part 2 axially extending outboard from the central part, and a cover 4 with slots 3*c*, a cover 4 and an electromotor 5. As shown in FIG. 7, front part 2 extends axially outboard from central part 3 which means that part 3 is closer to the longitudinal centerline (as viewed in FIG. 7 along the axial extent of the siren) as compared with part 2. Therefore, "outboard" refers to items farther from the longitudinal centerline or center plane as compared to another referenced item. Contrariwise, "inboard" means the item is closer to the center plane as compared to another reference item. Central part 3 includes a first portion which has circumferential slots 3*c*. Axially outboard from the first portion is front part 2. As shown in FIG. 7, front part 2 has a funnel-shaped nozzle open to the axial front end of the siren.

Figure 1:
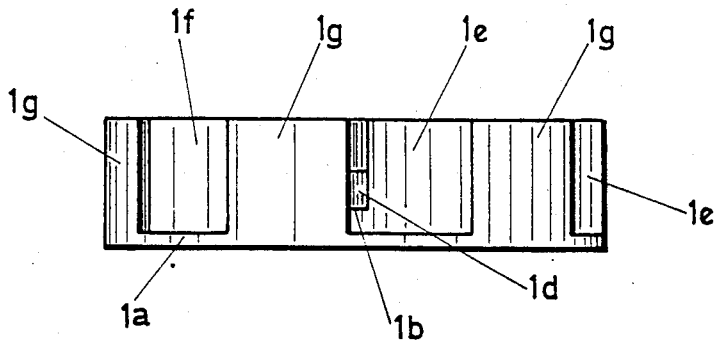
FIG. 1 illustrates a side view of the runner 1.

The runner 1 includes a circular plate 1*a* whose axially inboard back is flat, whereas in the centre of the front, at the radially innermost portion of the axially outboard front thereof, there is a convexity 1*d* with a bore for the shaft 5*a* of the electromotor 5. As can be seen by comparing FIGS. 1 and 7, the axially inboard face of runner 1 (the face on the right-hand side of the runner in FIG. 7) is flat. In contrast, the axial outboard face of runner 1 is not flat but has varying dimensions, i.e., compare in FIG. 1, rib 1*b*, convexity 1*d* and blades 1*c*. The convexity 1*d* extends as a continuity radially into several low ribs 1*b* that continue into higher blades 1*c*. Both the ribs 1*b* and blades 1*c* are arch-shaped away from the radius in such a way that the blades 1*c* tangentially approach the circumference of the runner 1, where they are formed as air cutters 1*g*. The outer arc 1*e* of the blade 1*c* is shorter than the inner arc 1*f*, the outer arc 1*e* being approximately as long as the air cutter 1*g*. There are spaces between the air cutters 1*g* being as long as the air cutters 1*g* themselves.

Figure 2:
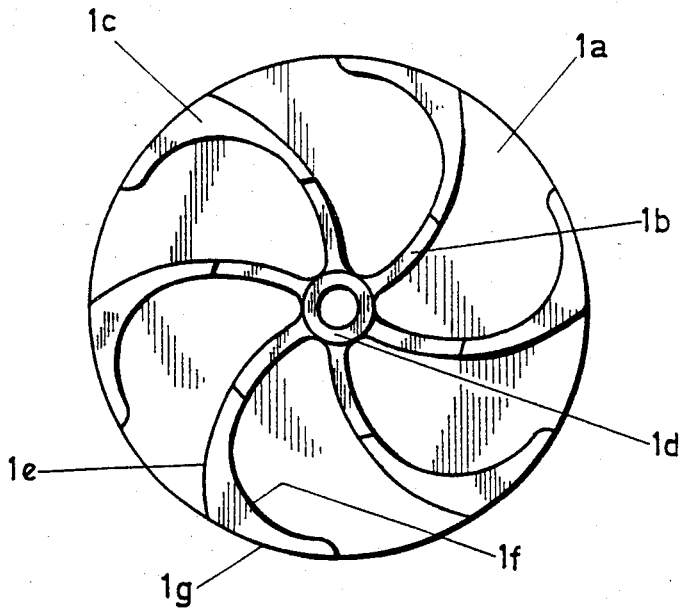
FIG. 2 illustrates a front view of the runner 1.
Figure 3:
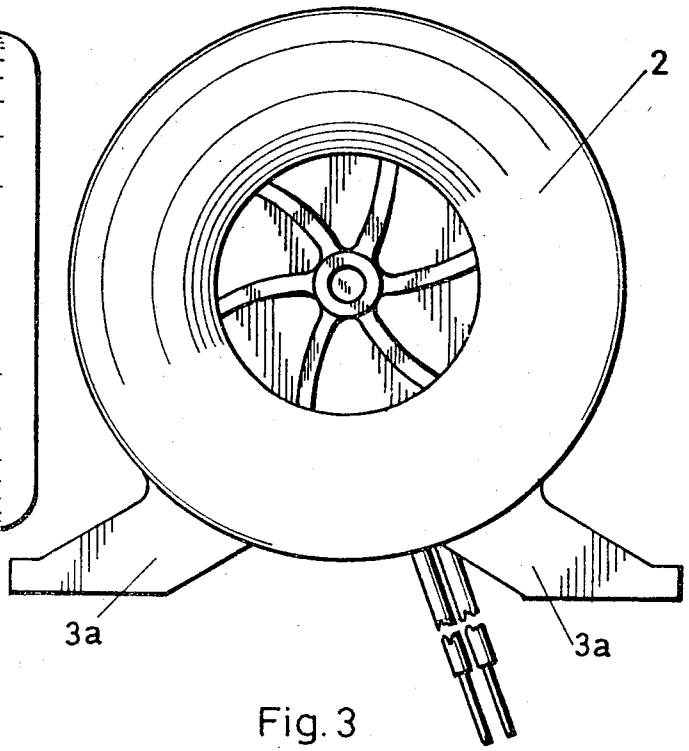
FIG. 3 illustrates a front view of the siren in accordance with the invention.
Figure 4:
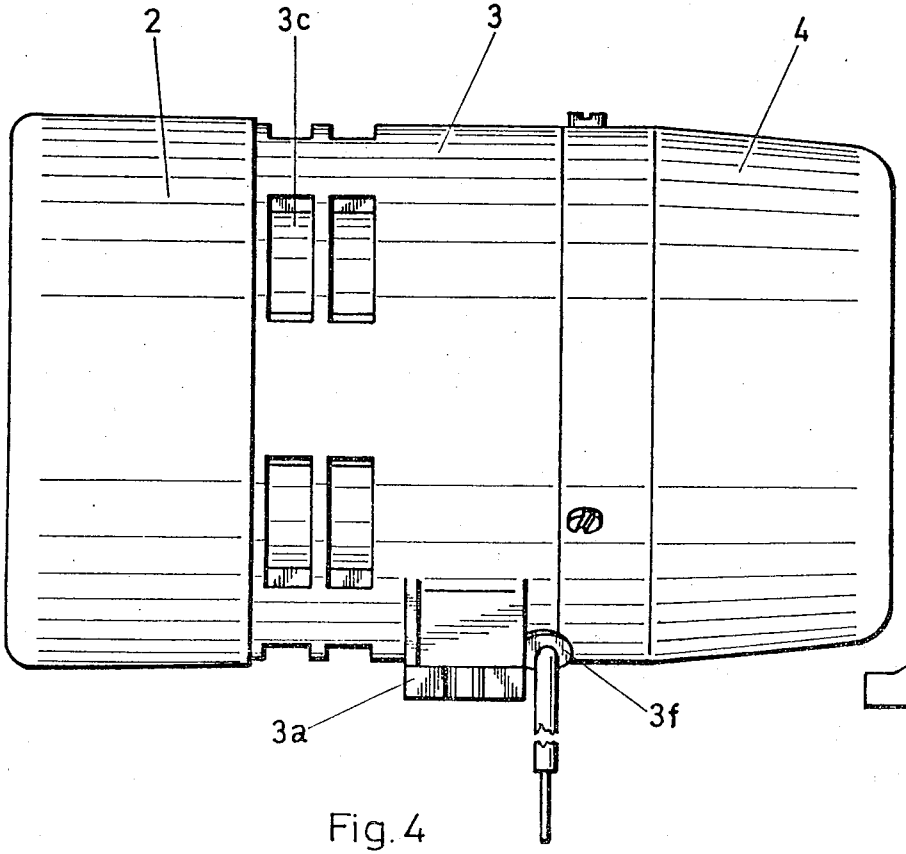
FIG. 4 illustrates a side view of the siren in accordance with the invention.
Figure 5:
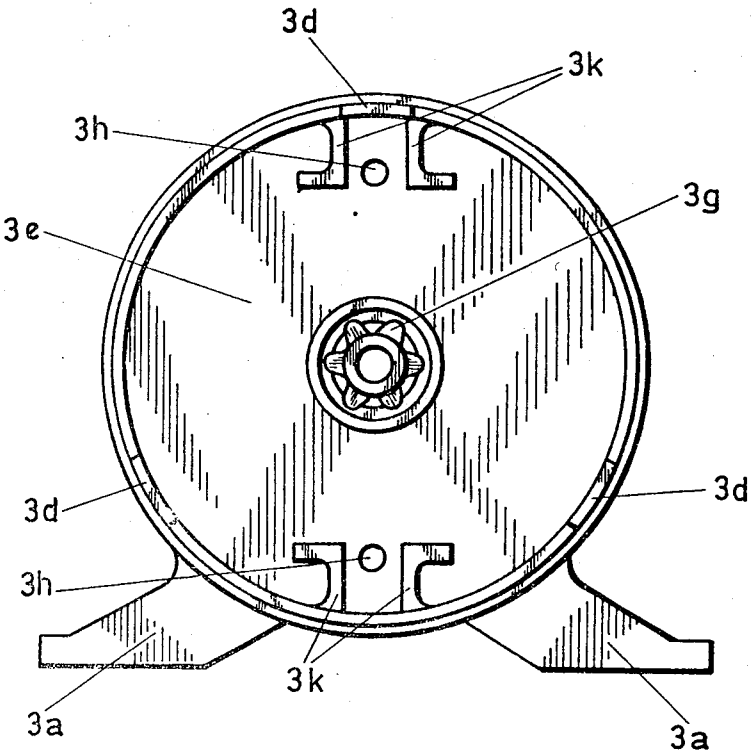
FIG. 5 illustrates a front view of the central part 3.
Figure 6:
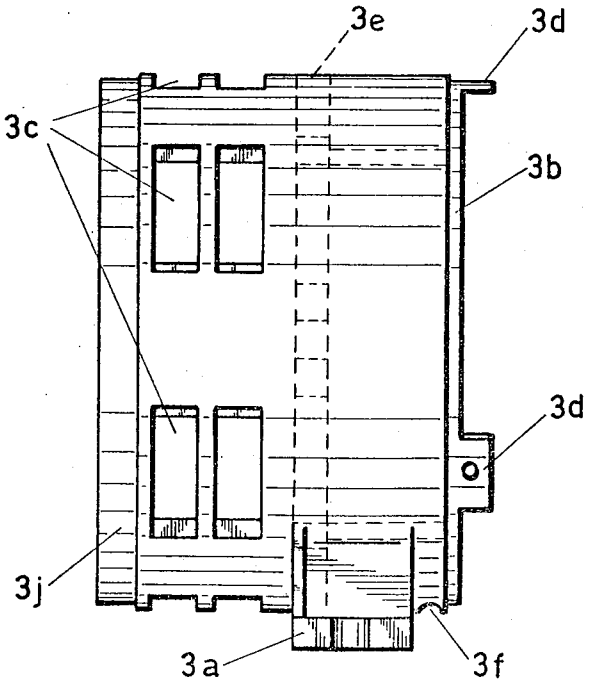
FIG. 6 illustrates a side view of the central part 3.

The runner 1 according to FIG. 2 is suitable only for a clockwise rotation.

The inwardly bent front part 2 of the siren forms a funnel-shaped nozzle and has a circular opening 2*a* in the middle. The inner circumference of the front part is intended to be fixed to the central part 3, viz. to the ring 3*j*.

The central part 3 is cylindrically shaped member having at its first half air slots 3*c* in the shape of rectangles being uniformly distributed in pairs arranged along the circumference.

The number of pairs of slots 3*c* equals the number of the air cutters of the runner 1. The first half ends with an axially outboard ring 3*j* onto which the front part 2 is fixed. In the second half of the central part 3, two legs 3*a* are fixed to the siren. The second half also ends with a narrow ring 3*b* of somewhat smaller diameter than the central part 3 itself; there are three right-angled appendages 3*d* with screw holes on it. At one leg 3*a* there is an opening 3*f* for a connecting cable.

In the middle of the central part 3 there is a partition wall 3*e* with a bearing part 3*g* intended to receive the shaft 5*a* of the electromotor 5; the wall is smooth and separates the acoustical portion of the siren from the driving portion. There are two bores 3*h* in the partition wall 3*e* for screw fastening of the motor 5. On the partition wall 3*e* at the bores 3*h*, four brackets 3*k* support the core of the electromotor 5.

The cover 4 encloses the electromotor 5 thereby providing a protection and compactness of the siren. Under the cover 4 there is beside the electromotor 5 a space provided for a relay. There are also three screw holes 4*a* on the cover 4.

The siren is assembled by sticking the shaft 5*a* of the electromotor into the bearing part 3*g* and by fixing the electromotor 5 with screws through the bores 3*h* in the partition wall 3*e* of the central part 3.

The cover 4 is fastened to the central part 3 by means of screws through the screw holes 4*a* and appendages 3*d*. A power supply cable extends through opening 3*f*.

The runner 1 is stuck on the shaft 5*a*, thereupon the front part 2 is firmly pressed upon the border of 3*b*.

What is claimed is:

1. A lower power electric alarm siren comprising: a central cylindrically shaped member divided by a partition wall into a first portion with slots along the circumference of said first portion and a second portion with fixing accessories for a motor; a runner rotatably mounted within said first portion of said central member, said runner having low ribs and high blades; a front part extending axially outboard from said first portion and having a funnel-shaped nozzle that is open at an axial front end of the siren and that forms a round bore terminating proximate said runner; an electromotor coupled to said runner and to said second portion; and a cover for said electromotor, wherein said runner includes a circular plate having a flat axially inboard back, a convexity at the radially inward portion of the axially outboard front thereof, a bore through the center of said plate for a shaft of said electromotor, said convexity radially extending as a continuity into said low ribs and into said higher blades; and ribs and blades being arc-shaped and continuously curved along the radial extent thereof such that the radially outer portions of said blades tangentially approach the circumference of said runner, said radially outer portions of said blades being formed into air cutters each having a circumferential span, the outer arc of each said blade being shorter than the inner arc thereof, the outer arc being approximately as long as said air cutter, and the blades defining radially outermost circumferential spaces between said air cutters, said spaces being as long as the circumferential span of said air cutters.

* * * * *